US007152378B2

(12) United States Patent
Takagi et al.

(10) Patent No.: US 7,152,378 B2
(45) Date of Patent: Dec. 26, 2006

(54) PANEL FORMING SYSTEM AND COMPONENTS

(75) Inventors: Kyozaburo Takagi, Centerville, OH (US); Gordon Charles Dodson, Lewis Center, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 97 days.

(21) Appl. No.: 10/290,118

(22) Filed: Nov. 7, 2002

(65) Prior Publication Data

US 2003/0084632 A1 May 8, 2003

Related U.S. Application Data

(60) Provisional application No. 60/344,835, filed on Dec. 21, 2001, provisional application No. 60/348,207, filed on Nov. 7, 2001.

(51) Int. Cl.
*E04B 1/16* (2006.01)

(52) U.S. Cl. ..... 52/381; 52/127.3; 249/189

(58) Field of Classification Search ..... 52/127.3, 52/127.2, 699, 293.1, 381, 380; 249/177, 249/189, 205, 188; 403/177, 178, 21, 387, 403/388

See application file for complete search history.

(56) References Cited

U.S. PATENT DOCUMENTS

| | | | | | |
|---|---|---|---|---|---|
| 640,075 | A | * | 12/1899 | Arnold | 404/3 |
| 2,298,184 | A | * | 10/1942 | Von Rosenberg | 52/167.1 |
| 3,166,816 | A | * | 1/1965 | Berg | 249/177 |
| 3,458,052 | A | * | 7/1969 | Kann | 211/193 |
| 3,561,801 | A | * | 2/1971 | Chiu | 403/264 |
| 3,778,175 | A | * | 12/1973 | Zimmer | 403/187 |
| 4,042,205 | A | | 8/1977 | Herrell | |
| 4,557,091 | A | * | 12/1985 | Auer | 52/282.3 |
| 5,015,117 | A | | 5/1991 | Pawlicki | |
| 5,247,773 | A | | 9/1993 | Weir | |
| 5,263,288 | A | * | 11/1993 | Yang | 52/79.6 |
| 5,271,687 | A | * | 12/1993 | Holka et al. | 403/233 |
| 5,343,666 | A | * | 9/1994 | Haddad et al. | 52/648.1 |
| 5,562,272 | A | | 10/1996 | McAbee et al. | |
| 5,603,475 | A | * | 2/1997 | Lim | 248/222.14 |
| 5,609,005 | A | | 3/1997 | Schierloh et al. | |
| D424,215 | S | | 5/2000 | Eyring et al. | |
| 6,182,416 | B1 | * | 2/2001 | Brackin | 52/745.09 |
| 6,279,868 | B1 | * | 8/2001 | Eyring et al. | 249/177 |
| 6,398,180 | B1 | | 6/2002 | Eyring et al. | |
| 6,460,829 | B1 | * | 10/2002 | Forbis et al. | 256/24 |

FOREIGN PATENT DOCUMENTS

| | | |
|---|---|---|
| CH | 475 451 A | 7/1969 |

(Continued)

*Primary Examiner*—Korie Chan
(74) *Attorney, Agent, or Firm*—Dinsmore & Shohl LLP

(57) ABSTRACT

The present invention relates to configurations of pre-cast panel forming systems and various components of the panel forming systems. In one embodiment, a bulkhead is provided wherein a cross-sectional support member is located at a point along the height dimension of the upstanding portion of the bulkhead so as to provide substantial resistance to reduction of the width dimension under significant panel forming pressure applied to one of the exterior faces of the upstanding walls. In accordance with 37 CFR 1.72(b), the purpose of this abstract is to enable the United States Patent and Trademark Office and the public generally to determine quickly from a cursory inspection the nature and gist of the technical disclosure. The abstract will not be used for interpreting the scope of the claims.

36 Claims, 19 Drawing Sheets

FOREIGN PATENT DOCUMENTS

| | | |
|---|---|---|
| DE | 20 12 032 A | 9/1971 |
| DE | 21 03 853 A | 8/1972 |
| DE | 196 43 009 C | 7/1997 |
| DE | 299 18 953 U | 3/2000 |

* cited by examiner

PANEL FORMING SYSTEM AND COMPONENTS

CROSS-REFERENCE TO RELATED APPLICATIONS

This application claims the benefit of two U.S. Provisional Applications—Ser. Nos. 60/348,207, filed Nov. 7, 2001, and 60/344,835, filed Dec. 21, 2001.

BACKGROUND OF THE INVENTION

The present invention relates forms and form supports used for creating cured pre-cast structures. More specifically, the present invention relates to configurations of pre-cast panel forming systems and various components of the panel forming systems.

Many residential and commercial construction methods involve the use pre-cast structures. Pre-cast panels, for example, are integral to the tilt-up construction process. In the tilt-up approach, concrete forms are arranged on a flat casting surface in the shape and dimension of the desired tilt-up panel and filled with concrete. When the concrete cures, the panel and the form are separated and the panel is tilted up into a preferred, typically vertical, orientation, where it can be joined to structural frames or other panels. The present inventors have recognized a need for improvements in pre-cast panel forming systems and in various components of the panel forming systems. The improvements introduced by the present invention have applicability in the tilt-up construction process and in other pre-cast construction processes.

BRIEF SUMMARY OF THE INVENTION

This need is met by the present invention wherein improvements in pre-cast panel forming systems and in various components of the panel forming systems are introduced. In accordance with one embodiment of the present invention, a bulkhead is provided comprising a base portion and an upstanding portion. The base portion and the upstanding portion define at least a portion of a monolithic structure of the bulkhead. The base portion is configured for securement to a panel forming slab. The upstanding portion comprises a pair of upstanding walls defining a height dimension of the upstanding portion. The upstanding walls comprise respective exterior and interior faces and are spaced from each other to define a width dimension of the upstanding portion. The bulkhead comprises at least one cross-sectional support member extending from an interior face of one of the pair of upstanding walls to an interior face of the other of the pair of upstanding walls. The cross-sectional support member is located at a point along the height dimension of the upstanding portion so as to provide substantial resistance to reduction of the width dimension under pressure applied to one of the exterior faces of the upstanding walls.

In accordance with another embodiment of the present invention, a bulkhead connector is provided comprising a base portion and an upstanding portion. The base portion and the upstanding portion define at least part of a monolithic structure. The upstanding portion comprises a pair of upstanding walls. The monolithic structure defines at least one bulkhead receiving area bounded in part by the pair of upstanding walls and the base portion. The bulkhead receiving area defines dimensions sufficient to accommodate an end portion of a bulkhead securely therein. The monolithic structure is characterized by a rigidity sufficient to resist significant deformation and breakage under a cross-longitudinal panel-forming pressure exerted upon a bulkhead having an end portion secured within the bulkhead receiving area.

In accordance with yet another embodiment of the present invention, a panel forming system is provided comprising a plurality of bulkheads and a plurality of bulkhead connectors interconnecting corresponding end portions of respective bulkhead members. Each of the bulkheads comprises a base portion and an upstanding portion. The base portion and the upstanding portion define a monolithic structure. The base portion is configured for securement to a panel-forming slab. The upstanding portion comprises a pair of upstanding walls defining a height dimension of the upstanding portion. The pair of upstanding walls comprise respective exterior and interior faces. Each of the bulkhead connectors comprises a base portion and an upstanding portion. The base portion and the upstanding portion define at least part of a monolithic structure. The upstanding portion comprises a pair of upstanding walls. The monolithic structure defines at least one bulkhead receiving area bounded in part by the pair of upstanding walls and the base portion. The bulkhead receiving area define dimensions sufficient to accommodate an end portion of one of the bulkheads securely therein. The monolithic structure is characterized by a rigidity sufficient to resist significant deformation and breakage under the cross-longitudinal panel-forming pressure exerted upon a bulkhead having an end portion secured within the bulkhead receiving area.

In accordance with yet another embodiment of the present invention, a longitudinal releasable panel insert is provided. The insert defines a cross section comprising first and second support portions oriented in substantially perpendicular relation to each other. A chamfered portion extends from the first support portion to the second support portion, wherein the chamfered portion and each of the first and second support portions define respective interior angles of the panel insert and a panel insert interior. At least one panel insert anchor extends from one or more of the chamfered portion and the first and second support portions in the general direction of the panel insert interior. A releasable extension is substantially co-planar with one of the first and second support portions. The releasable extension comprises a locking projection configured for engagement with a portion of a bulkhead for a panel forming system. A releasable coupling is configured to couple the releasable extension to a remainder of the panel insert and to enable non-destructive release of the releasable extension from the remainder of the panel insert.

In accordance with yet another embodiment of the present invention, a brace is provided. The brace is configured to oppose a cross-longitudinal panel-forming pressure applied to an upstanding portion of a panel-forming bulkhead. The brace portion comprises a multi-piece brace assembly. The multi-piece brace assembly comprises a bulkhead engaging extension and a bracket. The bracket includes a longitudinal securement slot configured to enable fixation of the bulkhead engaging extension in a plurality of different vertical positions relative to the bracket. The bulkhead engaging extension is configured to interlock with a locking channel disposed along an upper portion of the upstanding portion of the bulkhead.

In accordance with yet another embodiment of the present invention, a rustication coupling for a panel forming system is provided. The rustication coupling comprises a shell, an open end, and a bulkhead engaging end. The shell comprises outer dimensions configured to substantially mimic outer dimensions of a panel-forming rustication and inner dimensions configured to accommodate an end portion of a rustication within the shell. The open end is configured to accommodate the end portion of the rustication. The bulkhead engaging end is configured for engagement with a base portion of a bulkhead, wherein the bulkhead engaging end is configured to form barrier to the flow of uncured cementitious material along a contact profile defined by the base portion of the bulkhead and the bulkhead engaging end of the rustication coupling.

In accordance with yet another embodiment of the present invention, a panel forming system comprising a plurality of bulkheads, at least one rustication, and at least one rustication coupling is provided. Each of the bulkheads comprises a base portion and an upstanding portion. The rustication is configured for placement upon a panel-forming slab within a panel forming mold defined by the plurality of bulkheads. The rustication coupling comprises a shell an open end, and a bulkhead engaging end.

In accordance with yet another embodiment of the present invention, a stackable bulkhead is provided comprising a base portion, an upstanding portion, and a pair of complementary mating portions. One of the mating portions is defined in the base portion while the other mating portion is defined in the upstanding portion. The base portion and the upstanding portion are configured such that a pair of the bulkheads may be stacked upon each other with the base portion of one of the bulkheads engaged with the upstanding portion of another of the bulkheads.

Accordingly, it is an object of the present invention to provide improvements to pre-cast panel forming systems and the various components of the panel forming systems. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 3:
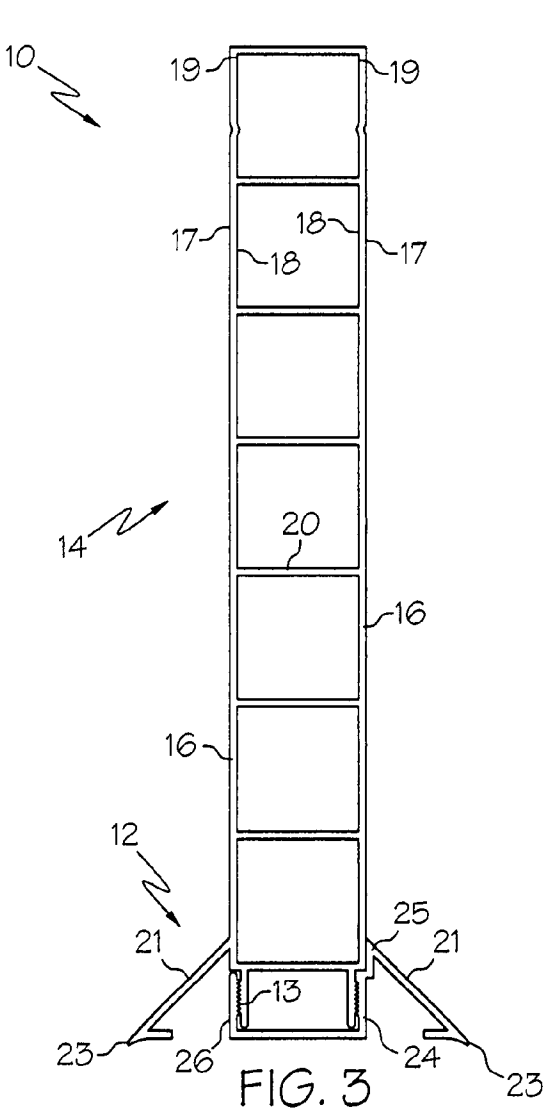
FIGS. 1–3 are illustrations of alternative bulkhead configurations according to the present invention.
Figure 4:
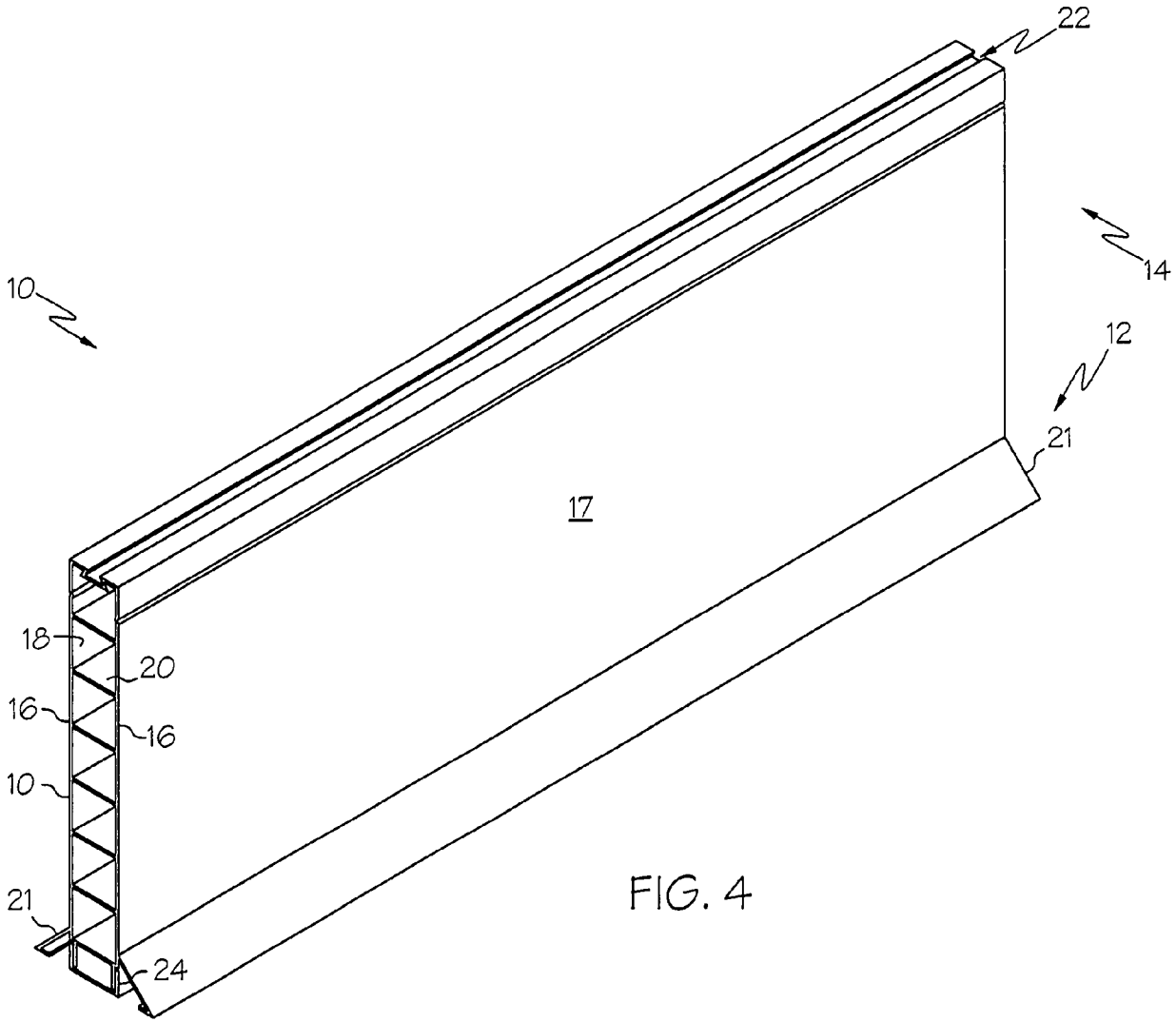
FIG. 4 is a three-dimensional illustration of a bulkhead configuration according to the present invention.
Figure 6:
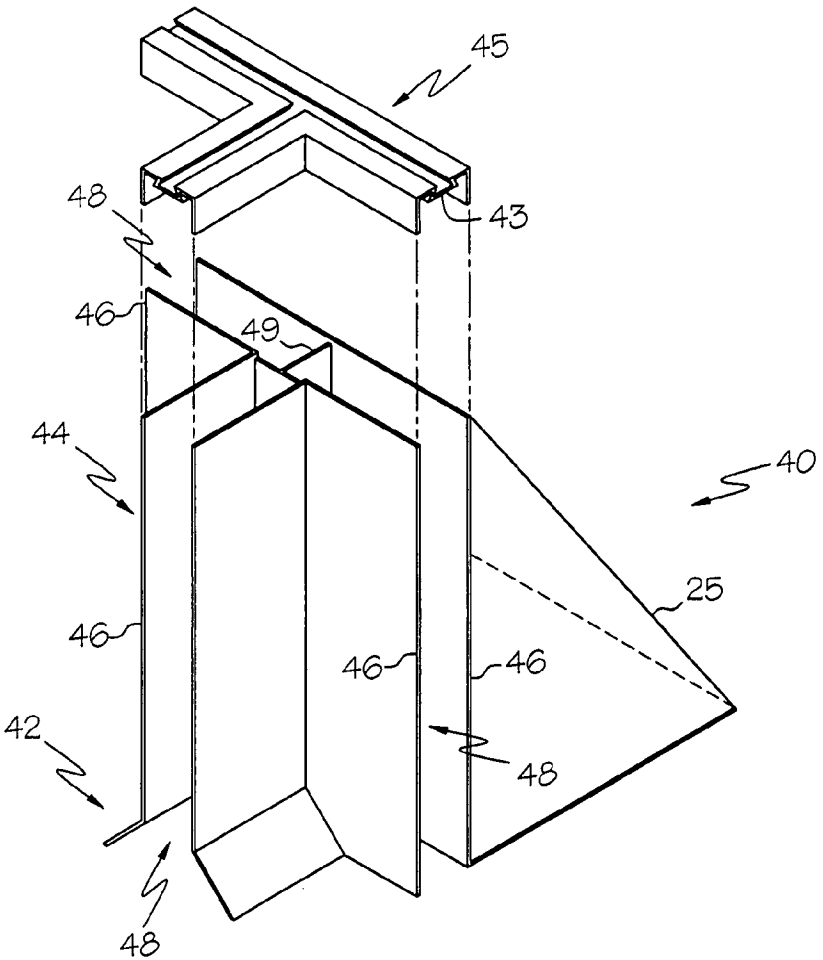
FIG. 6 is a three-dimensional illustration of a T joint bulkhead connector according to the present invention.
Figure 5:
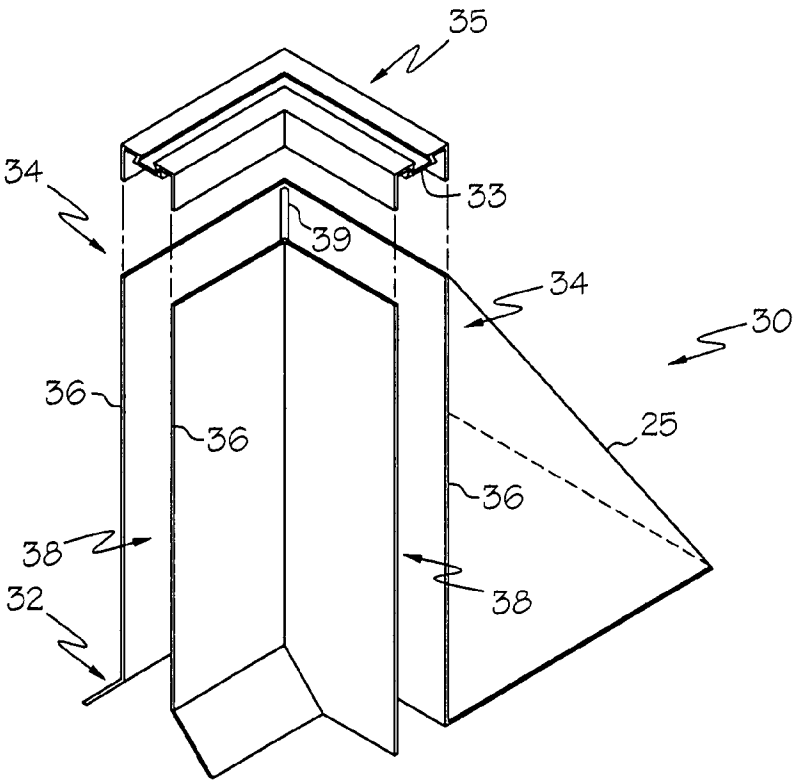
FIG. 5 is a three-dimensional illustration of a comer bulkhead connector according to the present invention.
Figure 7:
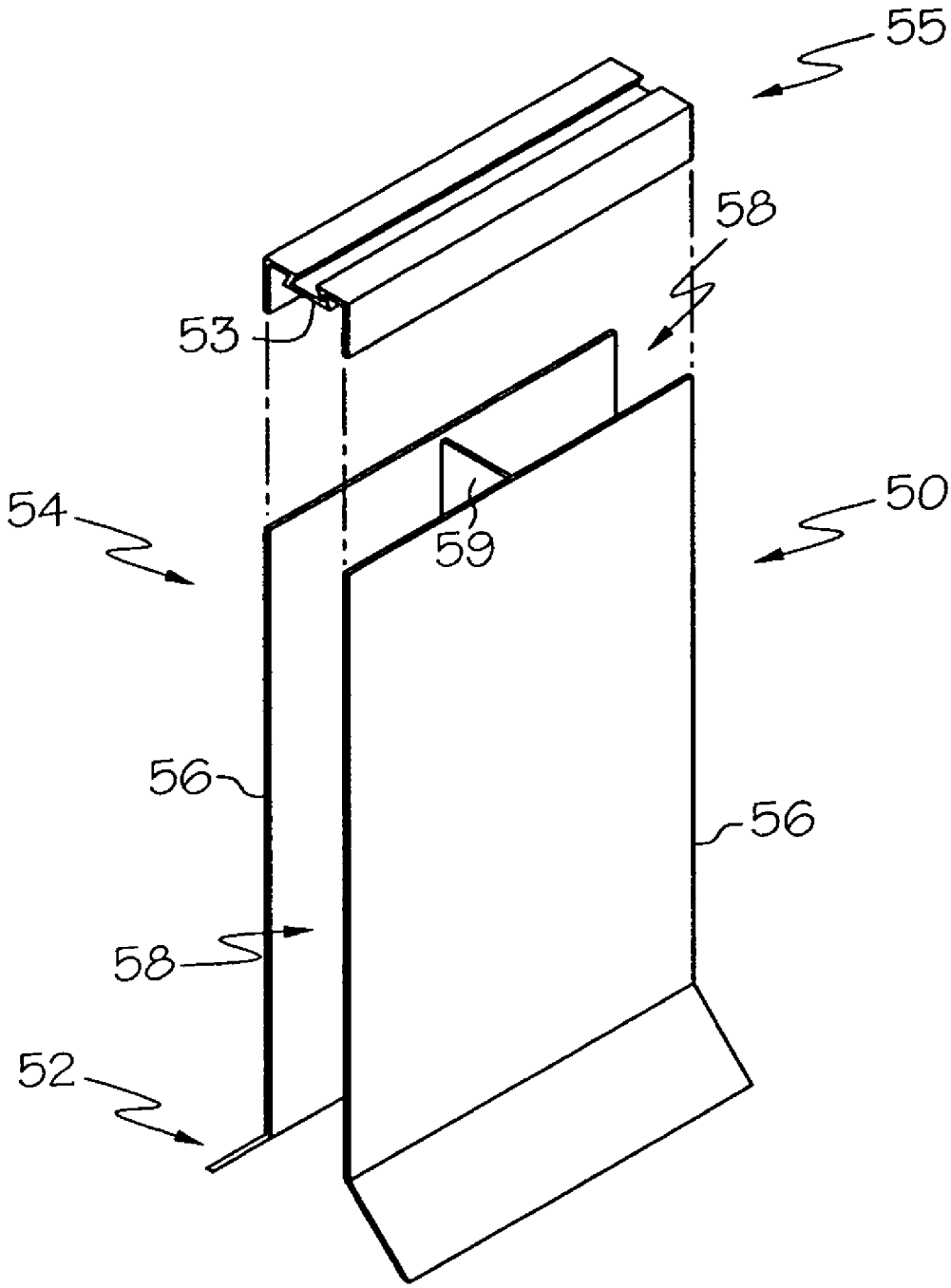
FIG. 7 is a three-dimensional illustration of an in-line bulkhead connector according to the present invention.

FIGS. 1–4 illustrate a variety of bulkheads 10 according to the present invention. FIGS. 5–7 illustrate a variety of bulkhead connectors 20, 30, 40 according to the present invention. Generally, referring to the schematic illustration of FIG. 8, a plurality of bulkheads 10 and a plurality of bulkhead connectors 30, 40, 50 may be configured as a panel forming system 60. A panel forming material may be poured or otherwise presented in respective panel sections 62, 64 of the panel forming system 60 and subsequently cured to form respective monolithic panels. The cured panels may be removed from the respective cavities 62, 64 and used in a variety of applications including, but not limited to, tilt-up and other pre-cast construction applications.

The panel forming system 60 and its various components may be formed from any of variety of suitable materials including, but not limited to, plastics, metals, resins, fibrous composites, and combinations thereof. One or more of the components of the panel forming system 60, which may include components in addition to the bulkheads 10 and connectors 30, 40, 50, may comprise partially or fully synthetic materials. For example, the synthetic or partially synthetic materials may comprise an extrudable material such as an extrudable plastic. Indeed, certain embodiments of the present invention relate directly to the bulkhead as an extruded member.

Referring initially to FIGS. 1–4, some bulkhead designs according to the present invention are illustrated. Each bulkhead 10 illustrated in FIGS. 1–4 comprises a base portion 12 and an upstanding portion 14. The base portion 12 and the upstanding portion define at least a portion of a monolithic structure of the bulkhead 10. For the purposes of defining and describing the present invention, it is noted that a monolithic structure constitutes a single unit devoid of any disconnecting joints or seams.

The base portion 12 is configured for securement to a panel forming slab 15 (see FIG. 8), as will be described in greater detail below. Although not illustrated as such in FIG. 8, the panel forming slab 16 typically extends beyond the boundaries of the panel forming system 60. The upstanding portion 14 comprises a pair of upstanding walls 16 defining a height dimension of the upstanding portion 14. Each of the upstanding walls 16 comprises an exterior face 17 and an interior face 18. The pair of upstanding walls 16 are spaced from each other to define a width dimension of the upstanding portion 14.

The bulkhead 10 comprises at least one cross-sectional support member 20 extending from an interior face 18 of one of the pair of upstanding walls 16 to an interior face 18 of the other of the pair of upstanding walls 16. At least one of the cross-sectional support members 20 is located at a point along the height dimension of the upstanding portion 14 so as to provide substantial resistance to reduction of the width dimension under pressure applied to one of the exterior faces 17 of the upstanding walls 14. In this manner, the integrity of the panel shape defined by each panel section 62, 64 of the panel forming system 60 may be maintained under the significant pressure created by uncured panel forming material present in each panel section 62, 64.

The bulkhead designs illustrated in the present application employ a plurality of these types of cross sectional support members 20 spaced along the interior faces of the pair of upstanding walls 16, including a support member at the terminal ends 19 of the pair of upstanding walls 16. An additional cross-sectional support member 20 may be positioned near the base portion 12. The cross sectional support members 20 may simply comprise a single linear extension that is substantially perpendicular to the pair of upstanding walls 16. Alternatively, the cross sectional support members 20 may be configured as more complex structures arranged in perpendicular or non-perpendicular configurations.

Figure 1:
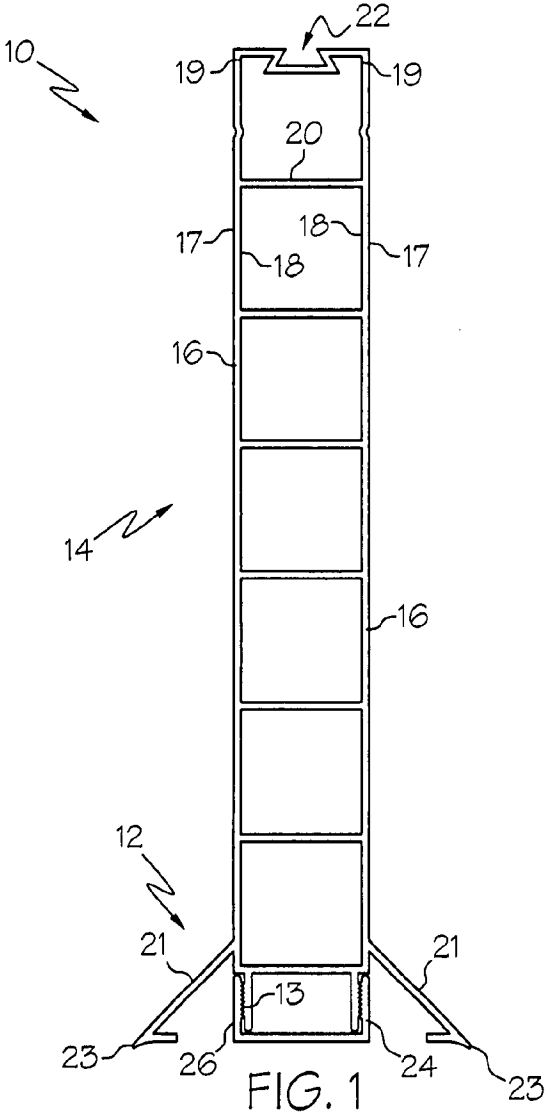

Referring specifically to FIG. 1, the cross-sectional support member 20 furthest displaced from the base portion 12 along an upper portion of the upstanding portion 14 may comprise a locking channel 22 defining a restricted locking channel opening 24. As is illustrated in FIG. 4, the locking channel 22 is defined along a longitudinal dimension of the bulkhead 10. The locking channel 22 illustrated in FIG. 1 is configured to permit forcible, repeatable engagement and disengagement of a locking projection with the locking channel 22. As will be described in further detail with reference to FIGS. 5–7, 24A and 24B, the presence of the locking channel 22 in the bulkhead 10 provides a means by which additional components including locking projections, such as connectors and braces, may be engaged with the upstanding portion 14 of the bulkhead 10.

Turning now to examples of how the base portion 12 of the bulkhead 10 may be configured for securement to a panel forming slab 15, the bulkhead 10 may further comprise a base clip 24. The base portion 12 is configured for securement to the panel forming slab 15 via the base clip 24. The base clip 24 may be secured to the panel forming slab 15 by any number of suitable means including adhesives, adhesive tapes, and mechanical fasteners such as nails or screws. In the illustrated embodiments, the base clip 24 is not part of the monolithic structure defined by the base portion 12 and the upstanding portion 14, although a monolithic structure incorporating the base clip 24 is not outside the scope of the present invention.

Figure 2:
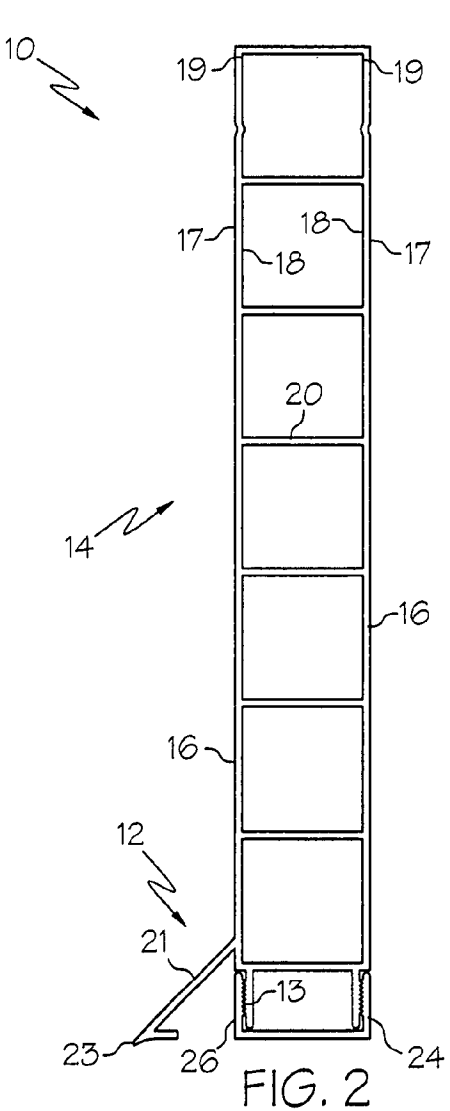

In the illustrated embodiments, providing the base portion 12 with at least one locking projection 13 configured for engagement with the base clip 24 enables securement to the slab 15. In the embodiments of FIGS. 1–3, the base portion 12 includes a plurality of relatively small locking projections 13. In the embodiments of FIGS. 16–19, where a variety of base clip 24 and base portion 12 configurations are illustrated, the base portion comprises a pair of relatively large locking projections 13. The locking projections 13 may extend from an interior face 18 of the upstanding walls 16 (see FIG. 17) or from a cross-sectional support member 20 extending between interior faces 17 of the upstanding walls 16 (see FIGS. 1–3, 16, 18, and 19). The pair of locking projections 13 may be configured to enclose at least a portion of the base clip 24 (see FIG. 17) or to be at least partially enclosed by the base clip 24 (see FIGS. 1–3, 16, 18, and 19).

The base clip 24 comprises a pair of base clip walls 26 and is configured to connect to the bulkhead 10 such that the pair of base clip walls 26 and the pair of upstanding walls 14 lie along respective substantially common planes. In this manner, a panel with substantially uniform edge faces may be cured within the panel sections 62, 64.

Figure 23:
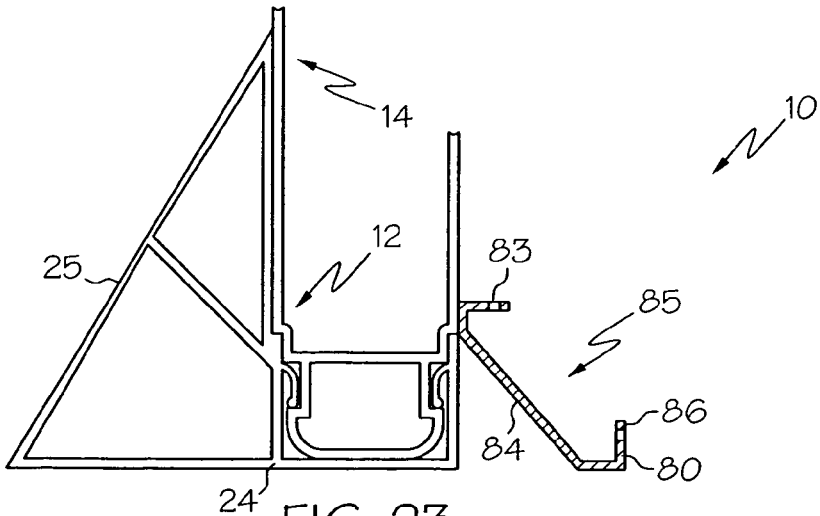
Figure 38:
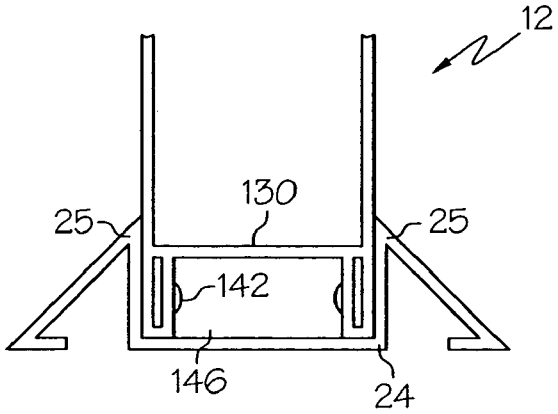

Referring to FIGS. 3, 23, and 38, the base clip 24 may comprise an integral brace portion 25 formed such that it is positioned on one side of the upstanding portion 14 when the base portion 12 is engaged with the base clip 24. The integral brace portion 25 is configured to oppose a cross-longitudinal panel forming pressure applied to a side of the upstanding portion 14 opposite the side at which the brace portion 25 is formed. In this manner the integral brace portion 25 provides stability to the bulkhead under the pressure of uncured panel forming material within one of the panel sections 62, 64. As will be described in further detail below, the integral brace portions 25 illustrated in FIGS. 3 and 38 may also be utilized to function as a panel forming chamfer in the panel forming process.

Referring now to an explanation of the manner in which chamfers may be provided in the bulkhead 10 of the present invention, it is initially noted that FIGS. 1–4 each illustrate a pair of chamfers 21. Presented in one of the panel sections 62, 64, a chamfered portion of the bulkhead 10 will form a chamfered surface in the cured panel. A chamfer 21 may be formed integral with the base portion 12, the base clip 24, or both. For example, in FIG. 1, the base portion 12 comprises a pair of integrally formed 21 extending outwardly from different ones of the pair of upstanding walls. In FIG. 2, the base portion 12 comprises a single integrally formed chamfer 21. In FIG. 3, the base portion 12 comprises a single integrally formed chamfer 21 and the base clip 24 comprises a single integrally formed chamfer 21. The chamfered portions 21 according to the present invention may comprise a sealing projection 23 configured for substantially isolated engagement with the slab 15 or any other planar surface oriented substantially perpendicular to the bulkhead 10. As is collectively illustrated in FIGS. 1–3, 8 and 9, the chamfered portions of the bulkhead 10 extend outwardly from a position substantially co-planar with an upstanding wall 16 to a position extending as far as, or beyond, the slab engaging face of the base clip 24.

Referring now to FIGS. 5–8, the structure and role of the bulkhead connectors 30, 40, 50 will be described in detail. Each bulkhead connector 30, 40, 50 comprises a base portion 32, 42, 52 and an upstanding portion 34, 44, 54 defining at least part of a monolithic structure. The upstanding portions 34, 44, 54 comprise at least one pair of upstanding walls 36, 46, 56. The monolithic structure of each connector defines at least one bulkhead receiving area 38, 48, 58 bounded in part by the pair of upstanding walls 36, 46, 56 and the base portion 32, 42, 52. Each of the bulkhead receiving areas 38, 48, 58 defines dimensions sufficient to accommodate an end portion of a bulkhead 10 securely therein. The degree of securement is preferably sufficient to serve as a barrier to the flow of uncured cementitious material between the connector 30, 40, 50 and the end portion of the bulkhead 10. The monolithic structure of the connectors 30, 40, 50 is characterized by a rigidity sufficient to resist significant deformation and breakage under cross-longitudinal panel forming pressure exerted upon a bulkhead having an end portion secured within the bulkhead receiving area.

The bulkhead connectors 30, 40, 50 may further comprise at least one cross-sectional support member 39, 49, 59 extending from an interior face of one of the pair of upstanding walls 16 to an interior face of the other of the pair of upstanding walls 16. In addition, the base portion 32, 42, 52 may comprise chamfered portions 21. An integral or separate brace portion 25 may also be provided and configured to oppose the cross-longitudinal panel forming pressure exerted by uncured panel forming material. Cross-longitudinal panel forming pressures are typically at least as large as that produced by an uncured cementitious mixture having length and width dimensions of at least six feet (about 2 meters) and a thickness dimension of at least four inches (about 10 cm).

The bulkhead connectors 30, 40, 50 may further comprise connector caps 35, 45, 55 sized and configured to complement the size and configuration of the upstanding portions 34, 44, 54 of the bulkhead connectors 30, 40, 50. The connector caps 35, 45, 55 may be configured to form a sealed interface with the upstanding portions 34, 44, 54 and may comprise locking projections 33, 43, 53 configured to engage an end portion of a bulkhead secured within the bulkhead receiving areas 38, 48, 58.

Figure 8:
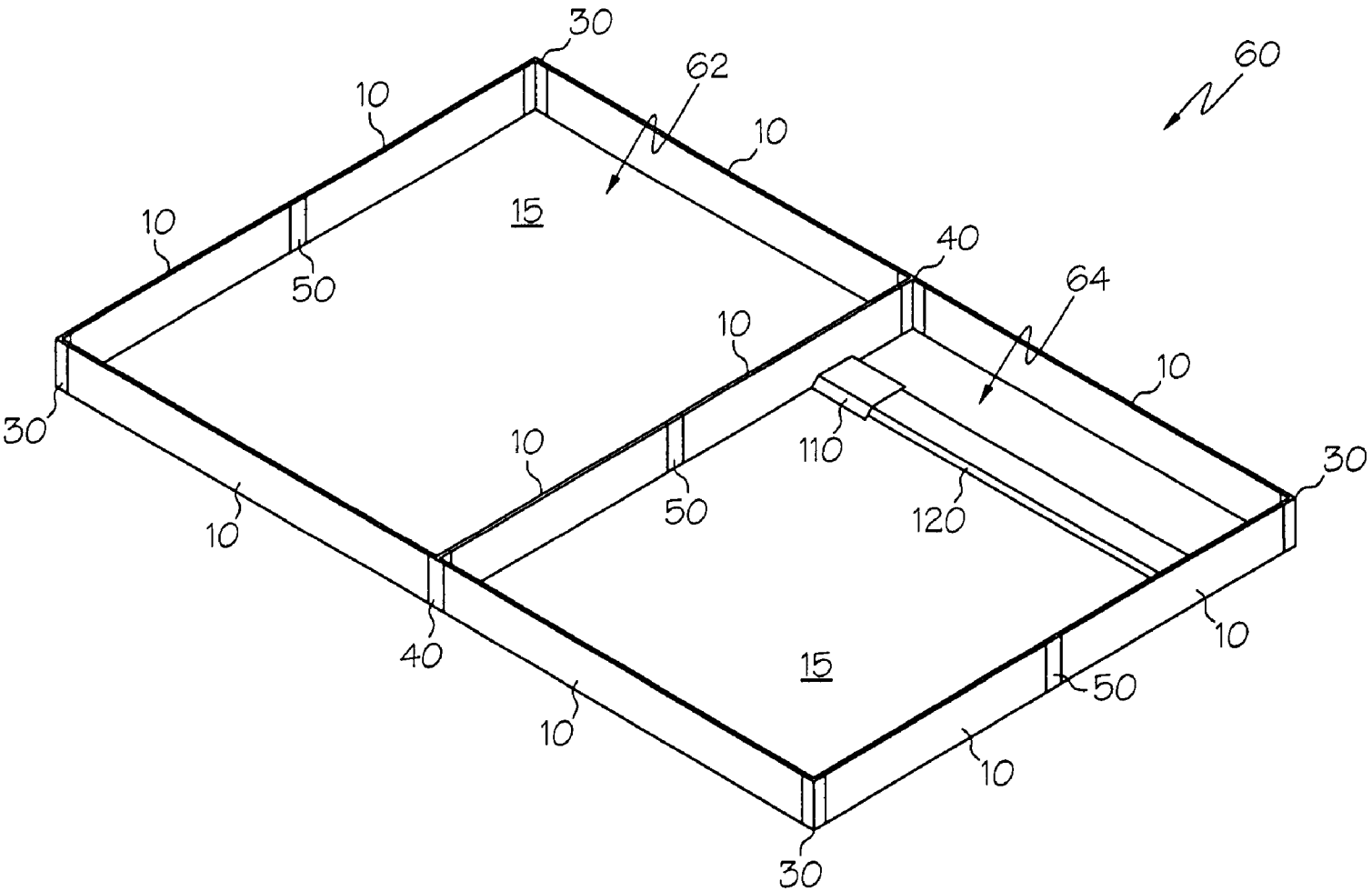
FIG. 8 is a schematic illustration of a panel forming system according to the present invention.
Figure 9:
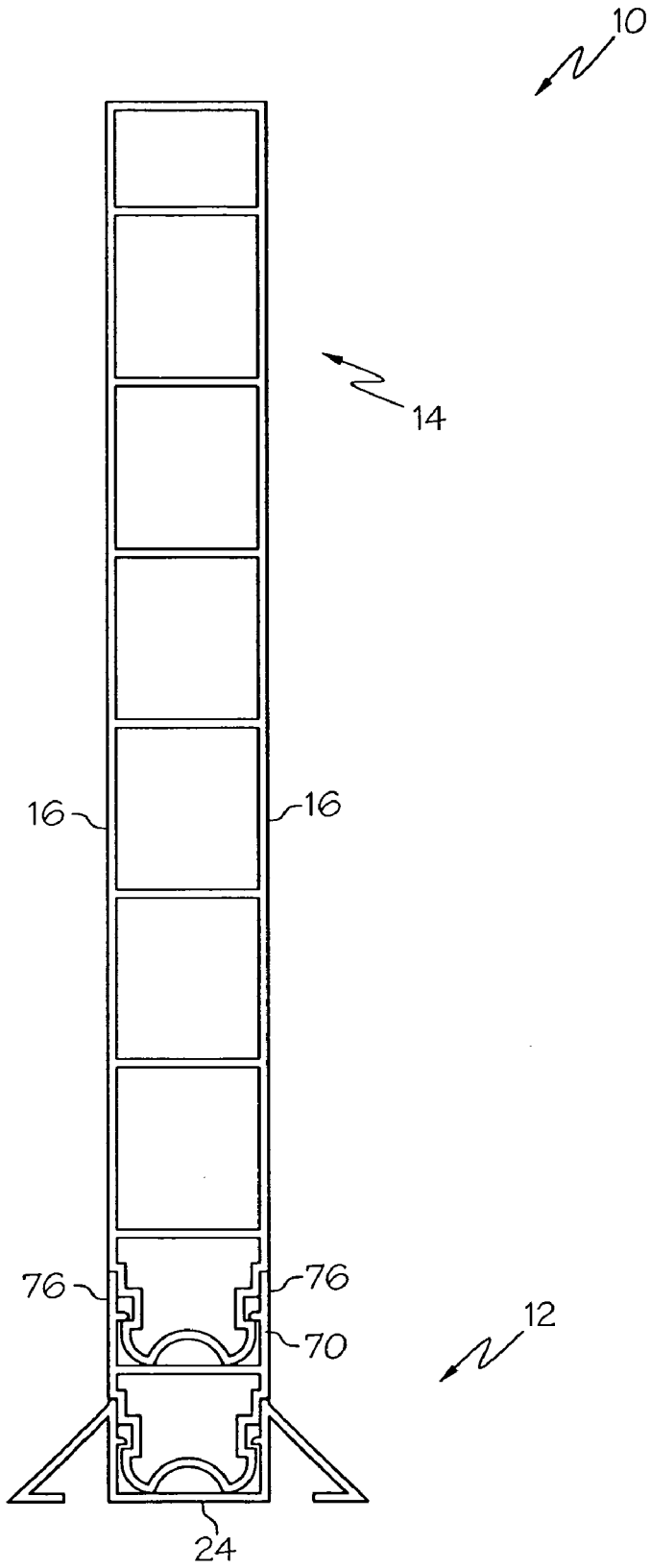
FIGS. 9–11 are illustrations of bulkhead configurations including bulkhead intermediates according to the present invention.
Figure 10:
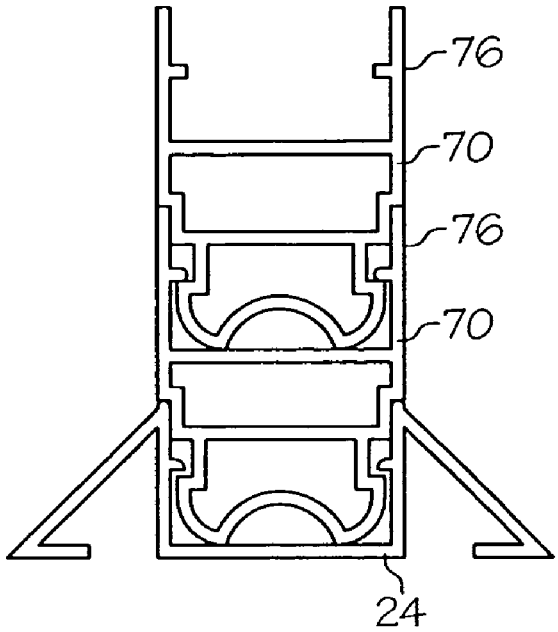
Figure 11:
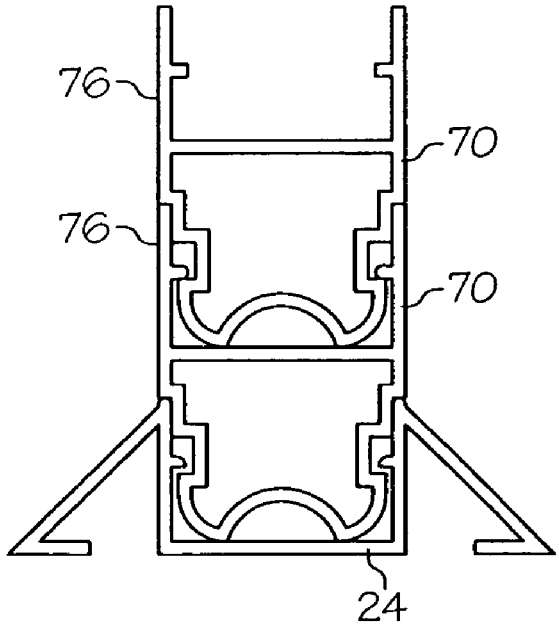
Figure 12:
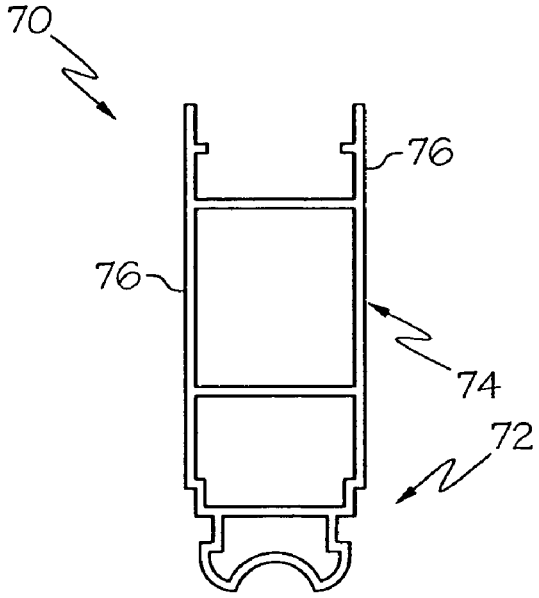
FIGS. 12–15 are illustrations of alternative bulkhead intermediates according to the present invention.
Figure 13:
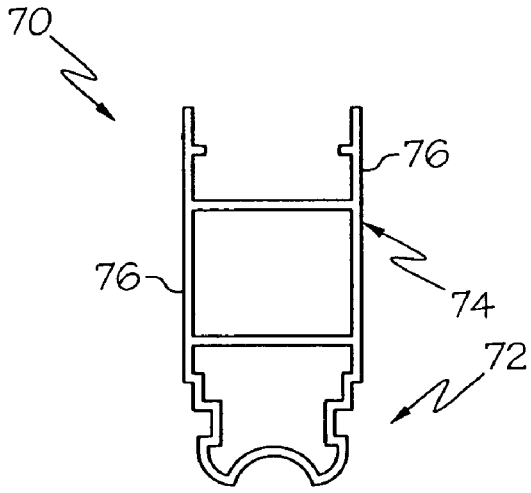
Figure 14:
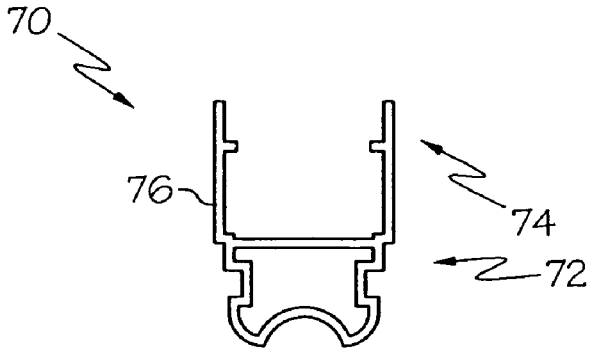
Figure 15:
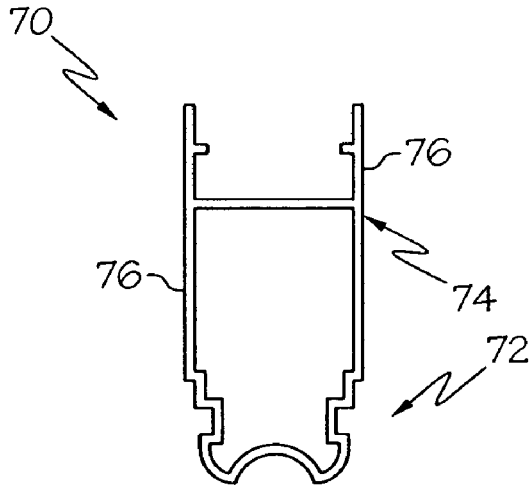
Figure 16:
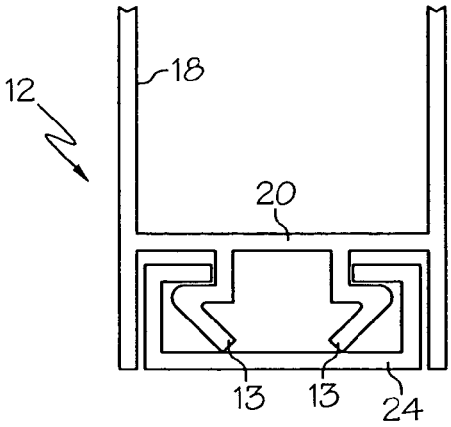
FIGS. 16–19 illustrate a variety of base clip configurations according to the present invention.
Figure 17:
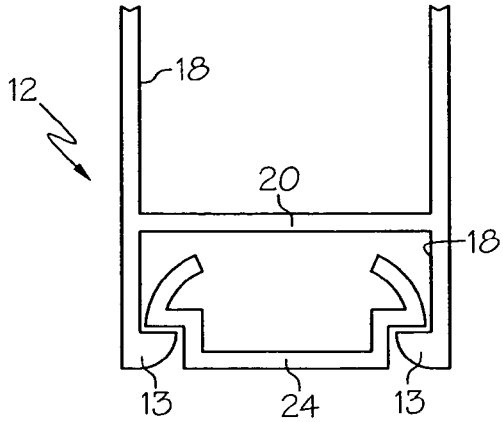
Figure 18:
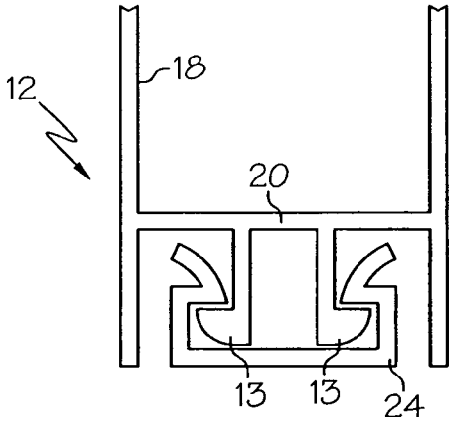
Figure 19:
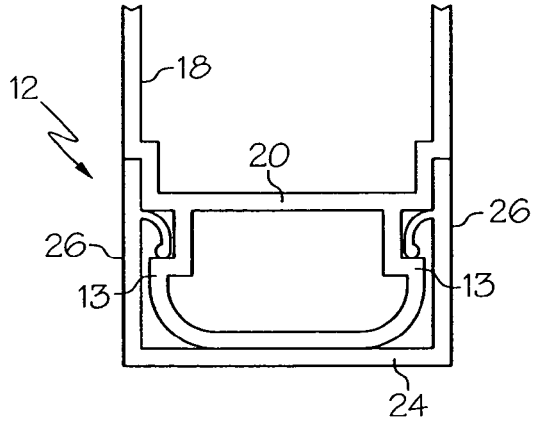

Referring specifically to the corner bulkhead connector 30 of FIG. 5, it is noted that the monolithic structure comprises two pairs of upstanding walls 36, each defining a separate bulkhead receiving area 38 oriented in a substantially orthogonal manner. The T joint bulkhead connector 40 of FIG. 6, also comprises first and second pairs of upstanding walls 46. One of the pairs of upstanding walls 46 defines first and second bulkhead receiving areas 48. The remaining pair of upstanding walls 46 defines a third bulkhead receiving area 48. The first and second bulkhead receiving areas 48 are oriented substantially along a common axis while the third bulkhead receiving area 48 is oriented in a substantially orthogonal manner, relative to the first and second bulkhead receiving areas 48. The in-line joint connector 50 of FIG. 7 comprises one pair of upstanding walls 56, which defines first and second bulkhead receiving areas 58 oriented substantially along a common axis. FIG. 8, illustrates schematically the manner in which each of the connectors 30, 40, 50 may be employed in a panel forming system 60 according to the present invention.

Referring to FIGS. 9–15, the bulkhead 10 of the present invention may also incorporate one or more bulkhead intermediates 70 comprising a pair of intermediate upstanding walls 76 that complement and serve to extend the upstanding walls 16 of the bulkhead 10. As is the case with the base clip 24 described herein, the bulkhead intermediate 70 and the bulkhead 10 are configured to define a releasable connection there between. In addition, the bulkhead intermediate 70 is configured to connect to the bulkhead 10 such that the pair of intermediate upstanding walls 76 and the pair of upstanding walls 16 lie along respective substantially common planes.

Each of the bulkhead intermediates 70 may comprise a pair of complementary mating portions 75, one of the pair of mating portions 75 being defined in a base portion 72 of the intermediate 70, another of the pair of mating portions 75 being defined in an upstanding portion 74 of the intermediate 70. The base portion 72 and the upstanding portion 74 are configured such that a pair of the intermediates 70 may be stacked upon each other with the base portion 72 of one of the intermediates 70 engaged with the upstanding portion 74 of another of the intermediates 70.

A bulkhead intermediate 70 and base clip 24 may also be configured to define a releasable connection there between. In addition, the bulkhead intermediate 70 may be configured to interconnect the base clip 24 and the monolithic structure defined by the base portion 12 and the upstanding portion 14 of the bulkhead 10 in a releasable manner. The number of bulkhead intermediates 70 incorporated in the bulkhead 10 of the present invention is merely a function of the available heights of the upstanding walls 16 and the intermediate upstanding walls 76 and desired height of the bulkhead 10.

Figure 20:
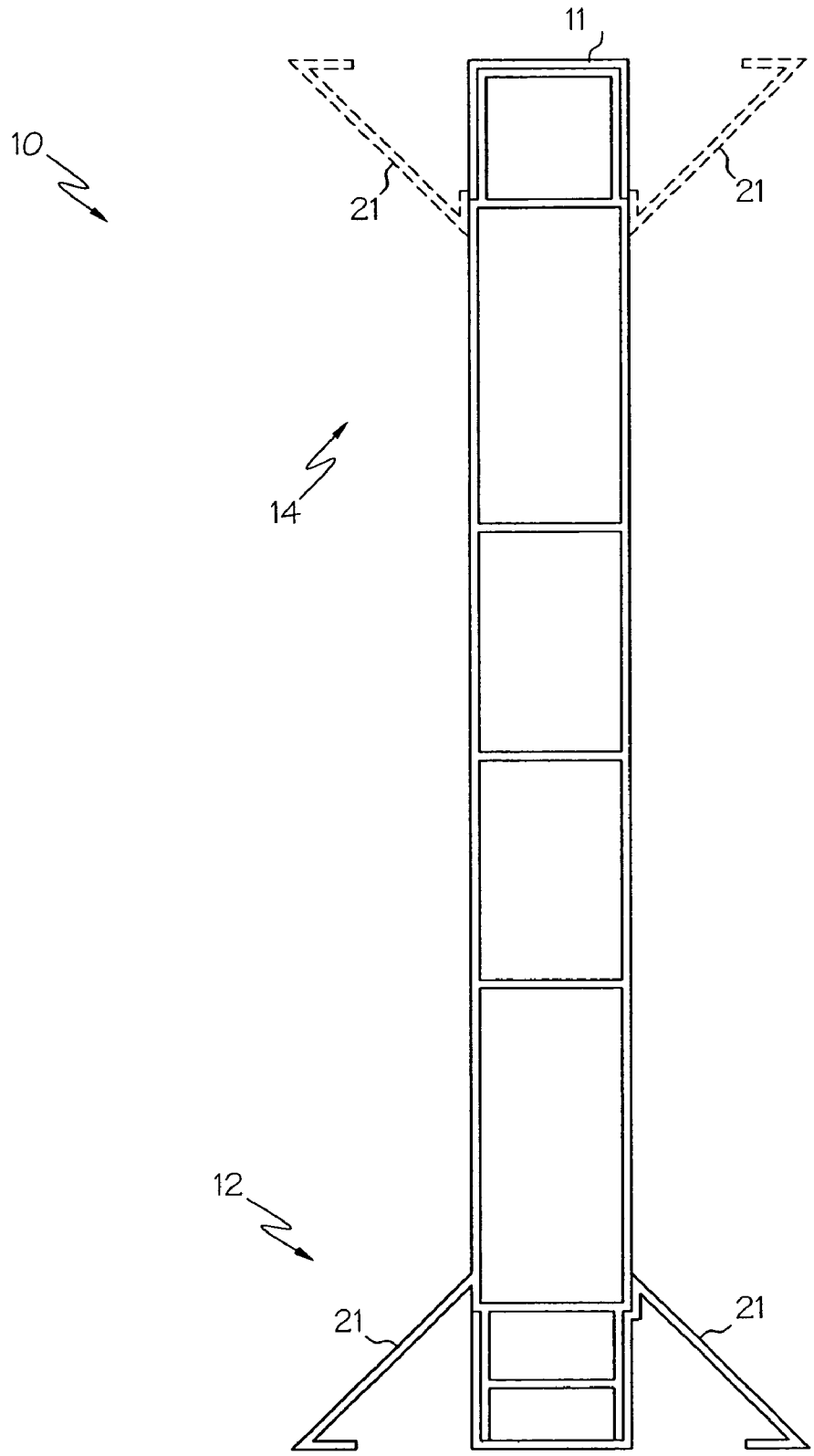
FIG. 20 illustrates a bulkhead including bulkhead cap variations according to the present invention.

Turning now to FIG. 20, the bulkhead 10 may further comprise a bulkhead cap 11 and an upper portion of the upstanding portion 14 of the bulkhead 10 may be configured to receive the bulkhead cap 11. As is illustrated in phantom in FIG. 20, the bulkhead cap may comprise one or more chamfers 21 in addition to chamfers 21 defined proximate the base portion 12 of the bulkhead 10. In this manner, chamfer portions may be formed on opposing major faces of a cured panel.

Figure 21:
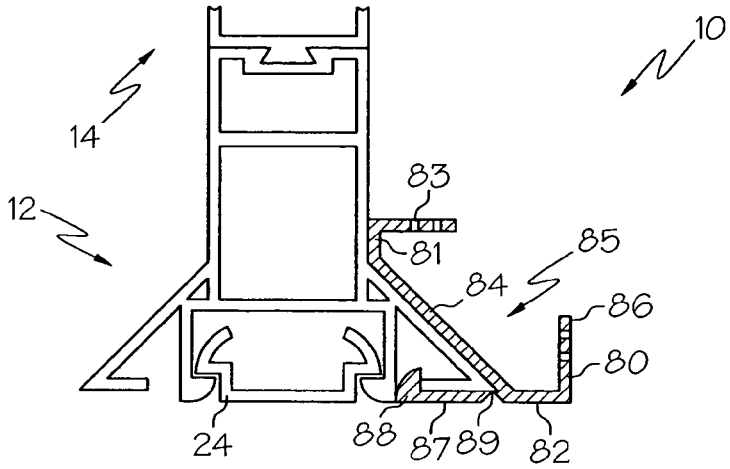
FIGS. 21–23 illustrate bulkhead and panel insert configurations according to the present invention.
Figure 22:
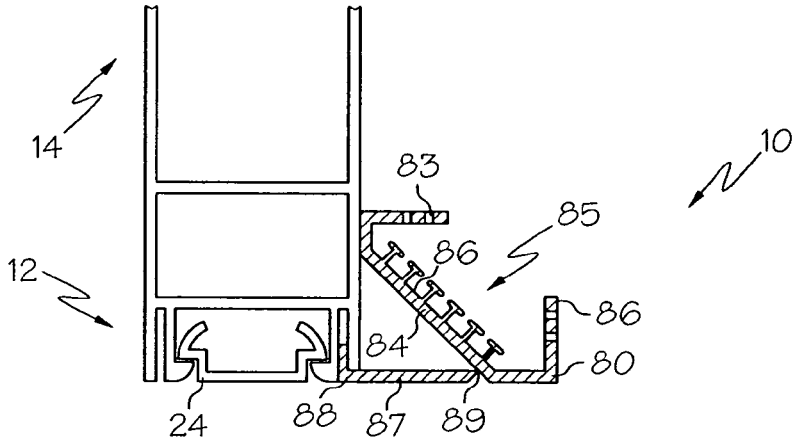

FIGS. 21–23 illustrate bulkhead configurations where the bulkhead 10 further comprises a longitudinal releasable panel insert 80 configured for engagement with the base portion 12 of the bulkhead 10. The cross section of the panel insert 80 comprises first and second support portions 81, 82 oriented in substantially perpendicular relation to each other and a chamfered portion 84 extending from the first support portion 81 to the second support portion 82. The chamfered portion 84 and each of the first and second support portions 81, 82 define respective interior angles θ of the panel insert and a panel insert interior 85. In the illustrated embodiment the interior angles θ are about 135°.

At least one panel insert anchor 86 extends from one or more of the chamfered portion 84 and the first and second support portions 81, 82 in the general direction of the panel insert interior 85. A releasable extension 87 substantially co-planar with the first support portion 81 comprises a locking projection 88 and may be configured for engagement with the base portion 12 or the base clip 24 of the bulkhead 10 (see FIGS. 21 and 22). A releasable coupling 89 is configured to couple the releasable extension 87 to a remainder of the panel insert 80 and to enable non-destructive release of the releasable extension 87 from the remainder of the panel insert. More specifically, the nature of the releasable coupling 89 is such that the remainder of the panel insert 80, when embedded in a cured panel, may be broken away cleanly from the releasable extension 87 by removing the cured panel from a panel forming system including the bulkhead 10 or otherwise separating the cured panel and the bulkhead 10. As will be appreciated by those familiar with pre-cast construction techniques, the embedded panel insert helps reduce damage to panel forming slabs over which the cured panel is moved.

A plurality of panel insert anchors 86 may be provided in the panel insert 80. For example, in FIGS. 21 and 23, a pair of panel insert anchors 86 are provided. The panel insert anchors 86 may be provided with one or more cross sectional vias 83 configured to permit passage of a cementitious material there through to improve adhesion of the insert 80 to the cured panel. Referring to FIG. 22, a plurality of suitably profiled panel insert anchors 86 may be provided extending from the chamfered portion 84.

Figure 24A:
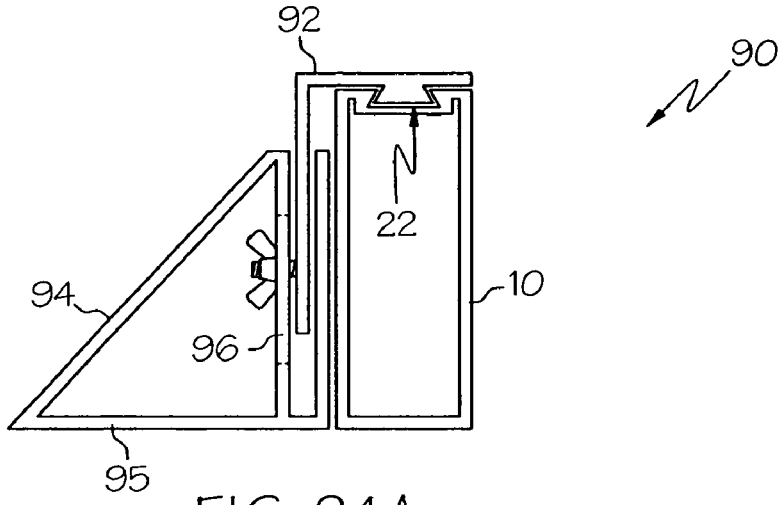
FIGS. 24A and 24B illustrate a bulkhead brace according to the present invention.
Figure 24B:
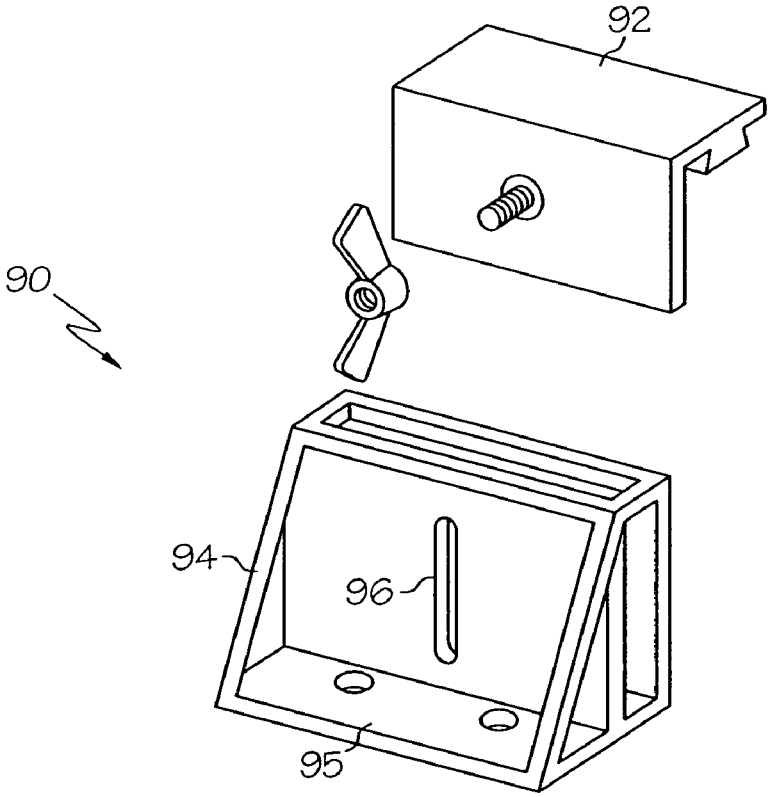

Referring to FIGS. 24A and 24B, a brace portion in the form of a multi-piece brace assembly 90 is illustrated. The multi-piece brace assembly 90 comprises a bulkhead engaging extension 92 and a bracket 94. The bracket 94 includes a longitudinal securement slot 96 configured to enable fixation of the bulkhead engaging extension 92 in any one of a plurality of different vertical positions relative to the bracket 94. The bulkhead engaging extension 92 is configured to interlock with a locking channel 22 disposed along an upper portion of the upstanding portion 14 of the bulkhead 10. The bracket 94 includes a generally planar base 95 and, as such, may be secured to the slab 15 or another panel forming surface by any suitable means including adhesives, adhesive tapes, and mechanical fasteners. In this manner, the bulkhead 10 may be securely braced against displacement during panel curing.

Figure 25:
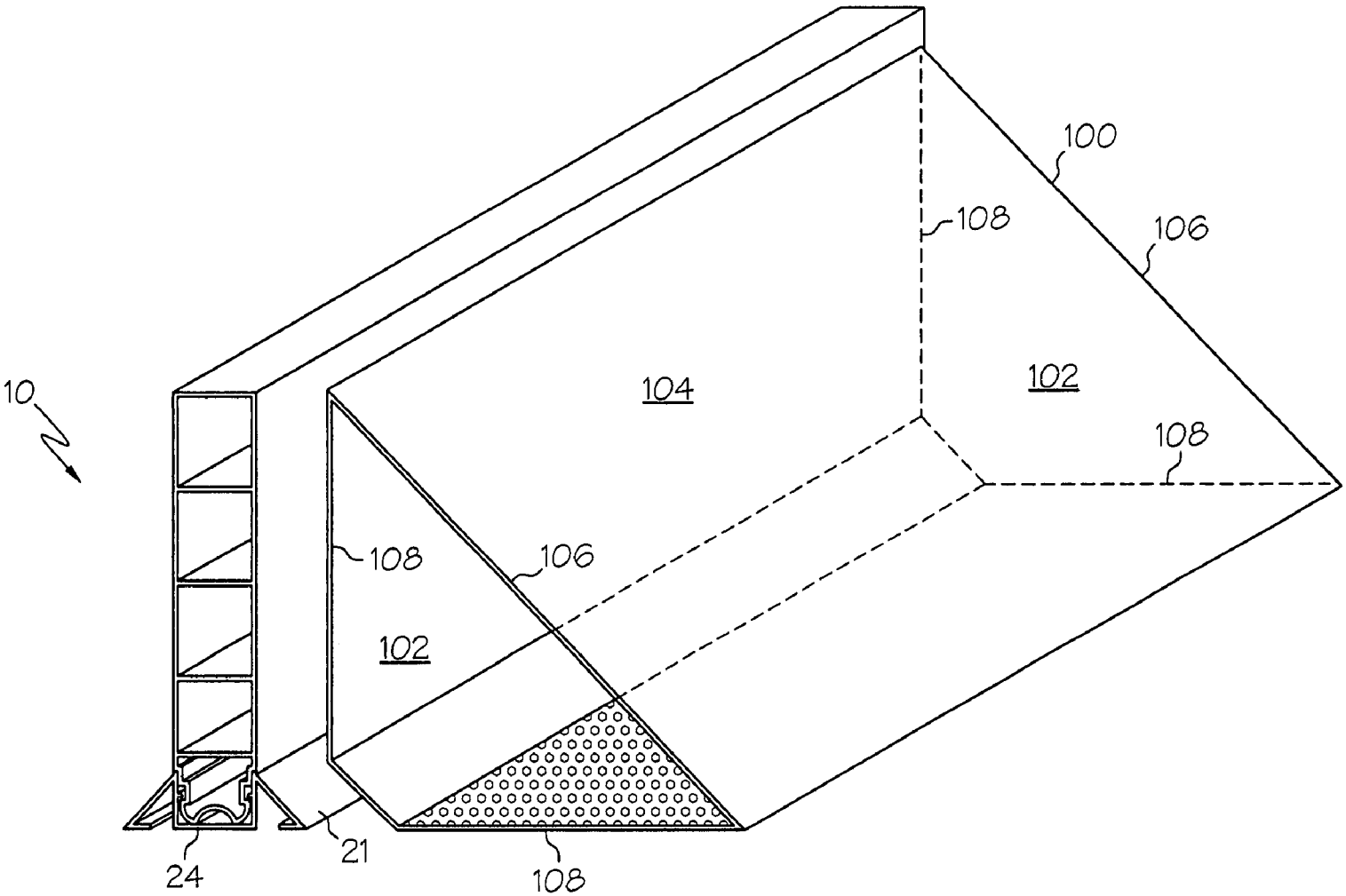
FIG. 25 illustrates a bulkhead brace according to another embodiment of the present invention.
Figure 26:
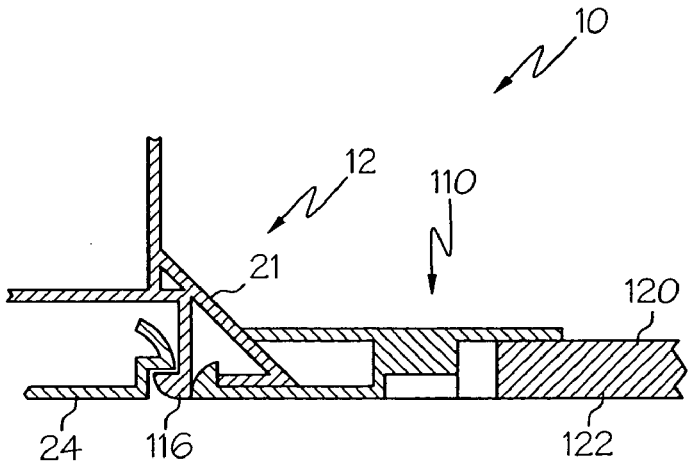
FIGS. 26–28 illustrate a bulkhead and rustication coupling according to the present invention.
Figure 27:
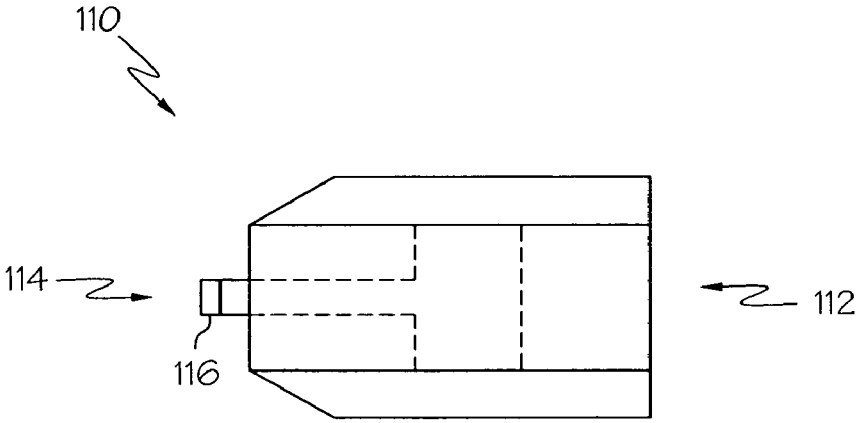
Figure 28:
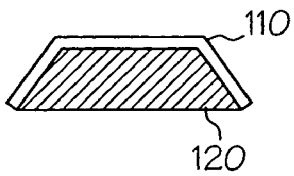

An alternative brace is illustrated in FIG. 25. The monolithic brace 100 illustrated in FIG. 25 comprises a pair of solid end faces 102 and a brace body 104 extending between the end faces 102. Each solid end face 102 defines a complementary major edge 106 of the brace 100 and at least two complementary minor edges 108 of the brace 100. The brace body 104 merely extends between the two complementary minor edges 108 of the solid end faces 102 and is open along a plane extending between the complementary major edges 106 of the end faces 102 to conserve material without sacrificing brace strength.

Referring again to FIG. 8, a rustication 120 may be utilized in a panel forming system 60 according to the present invention to create a particular profile or pattern in the surface of a panel cured therein. FIGS. 8 and 26–28 illustrate the inclusion of a rustication coupling 110 in the bulkhead 10 and panel forming system 60 of the present invention. The rustication coupling 110 comprises an open end 112 and a bulkhead engaging end 114 and is configured for engagement with the base portion 12 of the bulkhead 10 and with an end portion 122 of a rustication 120 and is particularly advantageous because it provides for some degree of tolerance to variations in the length of the rustication 120 while forming a barrier to the flow of uncured cementitious material along a contact profile defined by the base portion 12 of the bulkhead 10 and the bulkhead engaging end 114 of the rustication coupling 110.

Specifically, the rustication coupling 110 comprises a structure configured to define a shell, where the open end 112 of the shell is configured to accommodate the end portion 122 of the rustication 120 within the shell. The interior dimensions of the shell approximate the exterior dimensions of the end portion 122 of the rustication 120. The bulkhead engaging end 114 may comprise a locking projection 116 configured for engagement with the base portion 12 of the bulkhead 10.

Figure 29:
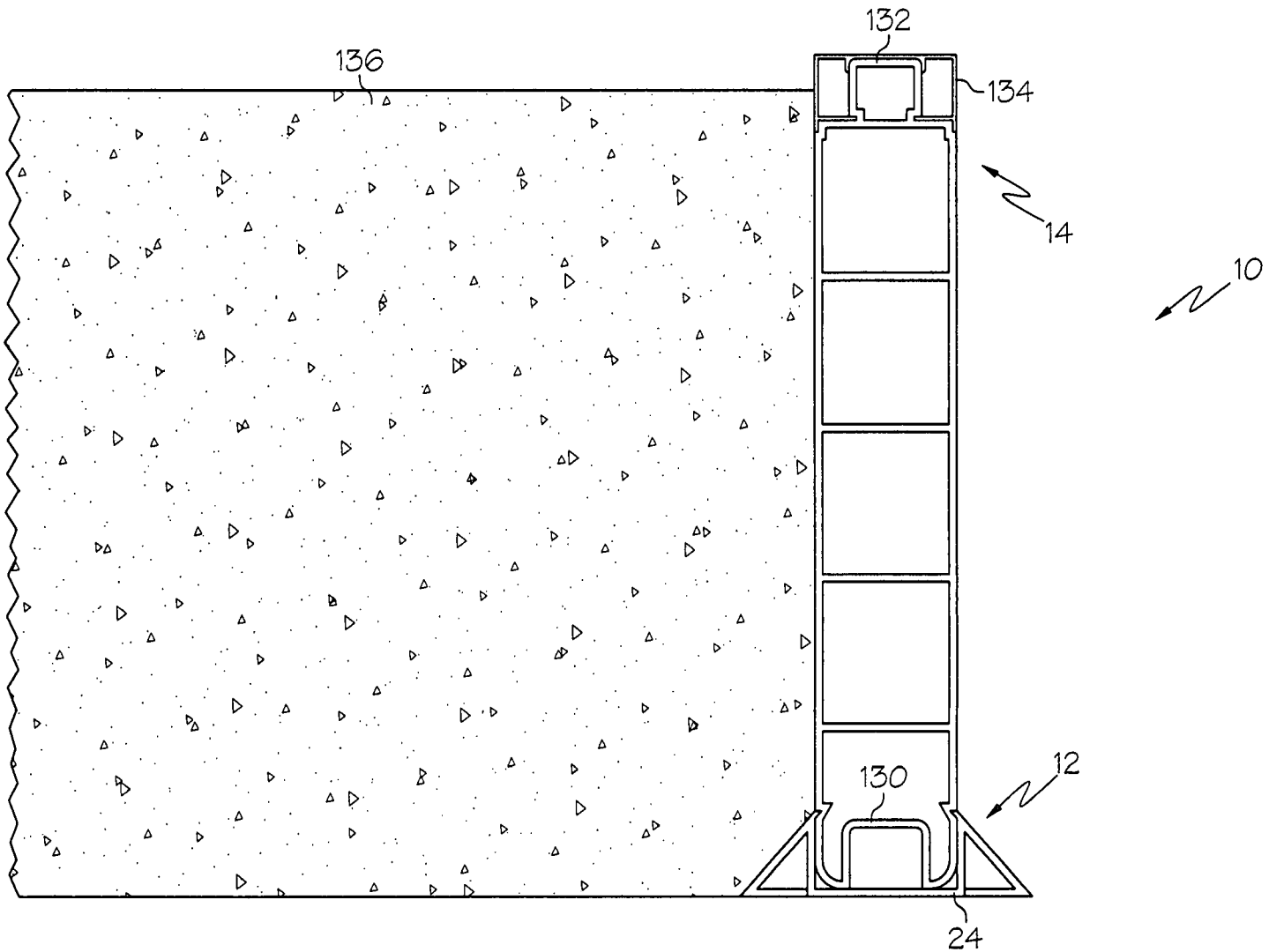
FIGS. 29–30 illustrate a stackable bulkhead assembly according to the present invention.
Figure 30:
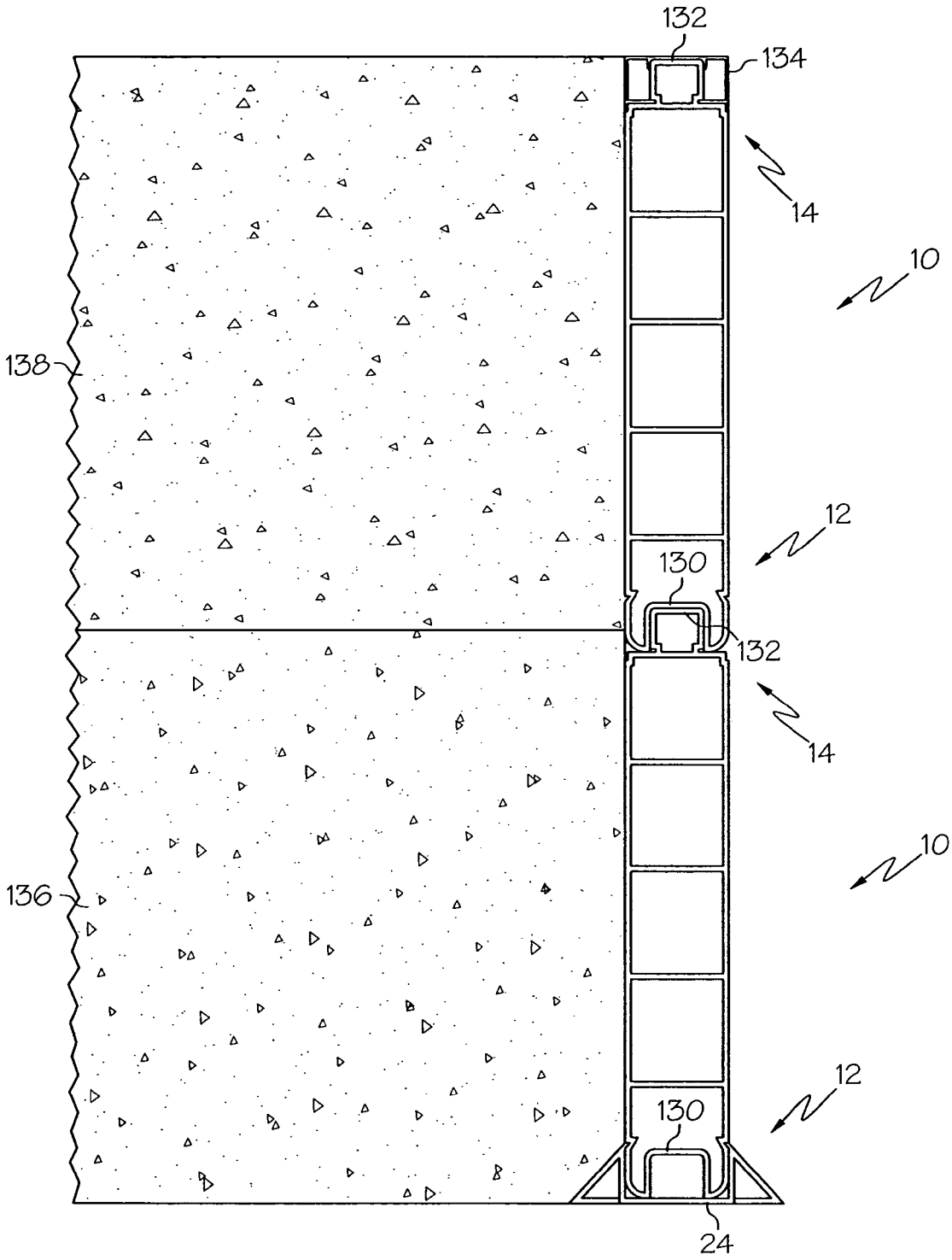
Figure 31:
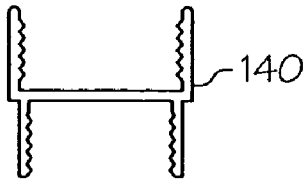
FIGS. 31–40 illustrate bulkhead stacking intermediates and bulkhead caps according to the present invention.
Figure 32:
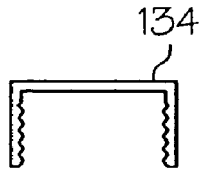
Figure 33:
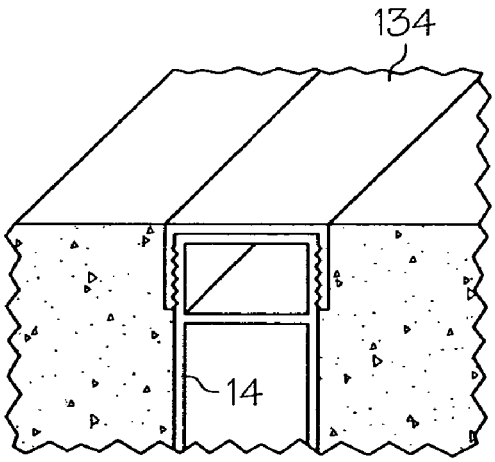
Figure 34:
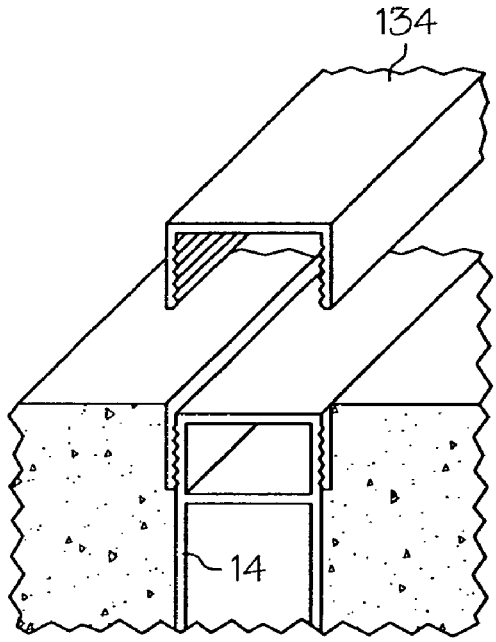
Figure 35:
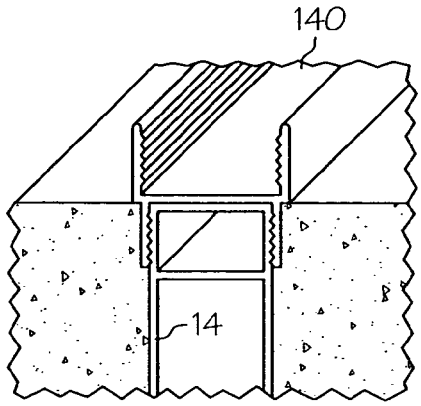

Referring to FIGS. 29 and 30, the bulkhead 10 of the present invention may further comprise a pair of complementary mating portions 130, 132. One of the pair of mating portions 130 being defined in the base portion 12, another of the pair of mating portions 132 being defined in the upstanding portion 14. The base portion 12 and the upstanding portion 14 are configured such that a pair of the bulkheads 10 may be stacked upon each other with the base portion 12 of one of the bulkheads 10 engaged with the upstanding portion 14 of another of the bulkheads 10. A bulkhead cap 134 may also be provided and may be configured to be releasable from the upstanding portion 14 of the bulkhead 10. In this manner, a first panel 136 may be formed and cured in the manner illustrated in FIG. 29 with the bulkhead cap 134 in place. Subsequent to curing, the bulkhead cap 134 may be removed and replaced with an additional bulkhead 10 having its own bulkhead cap 134, as is illustrated in FIG. 30. A second panel 138 may then be formed and cured directly over the first panel 136. Further panels may be formed in a similar manner.

Figure 36:
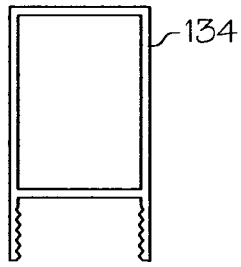
Figure 37:
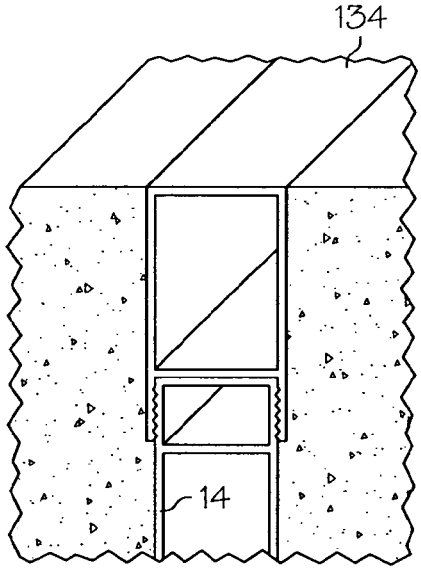

FIGS. 31–35 illustrate a further variation of a panel stacking scheme according to the present invention where the need for providing bulkheads with complementary mating portions is obviated. Specifically, a bulkhead stacking intermediate 140 interposed between the bulkheads 10 may complement engagement of the base portion 12 of one bulkhead 10 with an upstanding portion of another bulkhead 10. To form the stacked cured panels, the bulkhead cap 134 is replaced with the bulkhead stacking intermediate 140 after the first panel 136 is cured. Next, a subsequent bulkhead (not shown) may be installed for formation and curing of a second panel (not shown) because the intermediate 140 is configured to mate with and support a base portion 12 of an additional bulkhead 10 and the upstanding portion 14 of the existing bulkhead 10. FIGS. 36 and 37 illustrate utilization of bulkhead caps 134 that are configured to define an increased-height dimension of the upper terminus of the upstanding portion 14 of the bulkhead 10.

Figure 39:
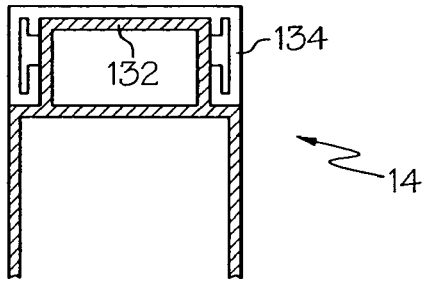
Figure 40:
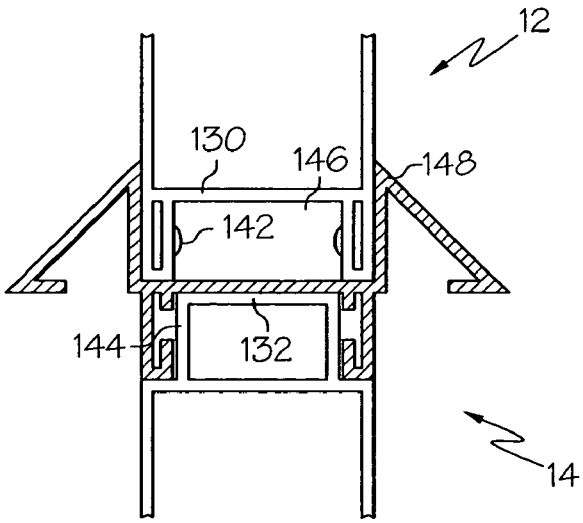

FIGS. 38–40 illustrate a further variation of a bulkhead stacking scheme employing a bulkhead 10 with a bulkhead cap 134 and complementary mating portions 130, 132 formed at the base portion 12 and upstanding portion 14 of the bulkhead 10. Also represented in FIG. 38 is the provision of relatively pliable widthwise projections 142 configured to enhance frictional engagement between a reduced-width upper terminus 144 of the upstanding portion 14 and a receptacle cavity 146 of the base portion 12. Either, the reduced-width upper terminus 144 or the receptacle cavity 146 may be provided with the relatively pliable widthwise projections 142. FIG. 40 illustrates the use of a chamfered bulkhead intermediate 148 upon removal of the bulkhead cap 134. In the embodiment of FIG. 40, the widthwise projections 142 would not yield the above-noted enhanced frictional engagement. However, absent the chamfered bulkhead intermediate 148, the frictional engagement would be as described with reference to FIGS. 38 and 39.

As will be appreciated by those familiar with the art of extrusion, an extruded member defines a substantially uniform extruded cross section that extends along substantially the entire length of the member. Insignificant variations in the uniformity of the cross section due to fabrication process errors or post fabrication process steps are contemplated. For example, holes may be drilled in an extruded member in specific locations after the member is extruded. Similarly, cuts or cutouts may be formed in the extruded member after it is extruded.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A bulkhead comprising a base clip, a base portion, and an upstanding portion wherein:

said base portion and said upstanding portion define at least a portion of a monolithic structure of said bulkhead;

said base portion is configured for securement to a panel forming slab via said base clip;

said base clip is not part of said monolithic structure defined by said base portion and said upstanding portion;

said base clip comprises a slab-engaging face configured to engage said panel forming slab;

said upstanding portion comprises a pair of upstanding walls defining a height dimension of said upstanding portion;

said pair of upstanding walls comprise respective exterior and interior faces;

said pair of upstanding walls are spaced from each other to define a width dimension of said upstanding portion;

said bulkhead comprises at least one cross-sectional support member extending from an interior face of one of said pair of upstanding walls to an interior face of the other of said pair of upstanding walls;

said cross-sectional support member is located at a point along said height dimension of said upstanding portion so as to provide substantial resistance to reduction of said width dimension under pressure applied to one of said exterior faces of said upstanding walls; and said bulkhead comprises at least one chamfered portion extending outwardly from a position substantially coplanar with one of said pair of upstanding walls to a position extending at least as far as said slab engaging face of said base clip.

2. A panel-forming system comprising a plurality of bulkheads and a panel forming slab wherein:

at least one of said bulkheads comprises a base clip, a base portion, and an upstanding portion;

said base portion and said upstanding portion define at least a portion of a monolithic structure of said bulkhead;

said base portion is configured for securement to said panel forming slab via said base clip;

said base clip comprises a slab-engaging face configured to engage said panel forming slab;

said upstanding portion comprises a pair of upstanding walls defining a height dimension of said upstanding portion;

said pair of upstanding walls comprise respective exterior and interior faces;

said pair of upstanding walls are spaced from each other to define a width dimension of said upstanding portion;

said bulkhead comprises at least one cross-sectional support member extending from an interior face of one of said pair of upstanding walls to an interior face of the other of said pair of upstanding walls;

said cross-sectional support member is located at a point along said height dimension of said upstanding portion so as to provide substantial resistance to reduction of said width dimension under pressure applied to one of said exterior faces of said upstanding walls;

said base clip is configured to connect to said base portion of said bulkhead; and said plurality of bulkheads are configured such that un-cured material can be contained within said panel forming system in the shape of a panel.

3. A system as claimed in claim 2 wherein said base clip is not part of said monolithic structure defined by said base portion and said upstanding portion.

4. A system as claimed in claim 2 wherein said base portion comprises at least one locking projection configured for engagement with said base clip.

5. A system as claimed in claim 4 wherein said base portion comprises a pair of locking projections.

6. A system as claimed in claim 5 wherein said locking projections extend from a cross-sectional support member extending from an interior face of one of said pair of upstanding walls to an interior face of the other of said pair of upstanding walls.

7. A system as claimed in claim 5 wherein said pair of locking projections are at least partially enclosed by said base clip.

8. A system as claimed in claim 2 wherein said base clip comprises a pair of base clip walls.

9. A panel-forming system comprising a plurality of bulkheads and a panel forming slab wherein:

at least one of said bulkheads comprises a base portion and an upstanding portion;

said base portion and said upstanding portion define at least a portion of a monolithic structure of said bulkhead;

said base portion is configured for securement to said panel forming slab;

said upstanding portion comprises a pair of upstanding walls;

said pair of upstanding walls comprise respective exterior and interior faces;

said pair of upstanding walls are spaced from each other;

said bulkhead comprises at least one cross-sectional support member extending from an interior face of one of said pair of upstanding walls to an interior face of the other of said pair of upstanding walls, wherein said cross-sectional support member is positioned near corresponding terminal ends of said pair of upstanding walls near said base portion; and said plurality of bulkheads are arranged on said panel forming slab to define length and width dimensions of a panel-shaped cavity such that panel forming material is entirely confined within said panel-shaped cavity to define a panel having peripheral dimensions matching the dimensions of said panel-shaped cavity.

10. A bulkhead comprising a base clip, a base portion, and an upstanding portion wherein:

said base portion and said upstanding portion define at least a portion of a monolithic structure of said bulkhead;

said base clip is not part of said monolithic structure defined by said base portion and said upstanding portion;

said upstanding portion comprises a pair of upstanding walls;

said pair of upstanding walls comprise respective exterior and interior faces;

said pair of upstanding walls are spaced from each other;

said bulkhead comprises at least one cross-sectional support member extending from an interior face of one of said pair of upstanding walls to an interior face of the other of said pair of upstanding walls;

said bulkhead comprises at least one chamfered portion extending outwardly from a position substantially coplanar with one of said pair of upstanding walls; and said chamfered portion comprises a sealing projection configured for substantially isolated engagement with a planar surface oriented substantially perpendicular to said bulkhead.

11. A bulkhead comprising a base clip, a base portion, and an upstanding portion wherein:

said base portion and said upstanding portion define at least a portion of a monolithic structure of said bulkhead;

said base clip is not part of said monolithic structure defined by said base portion and said upstanding portion;

said upstanding portion comprises a pair of upstanding walls;

said pair of upstanding walls comprise respective exterior and interior faces;

said pair of upstanding walls are spaced from each other;

said bulkhead comprises at least one cross-sectional support member extending from an interior face of one of said pair of upstanding walls to an interior face of the other of said pair of upstanding walls;

said bulkhead comprises at least one chamfered portion extending outwardly from a position substantially co-planar with one of said pair of upstanding walls; and said bulkhead comprises a locking channel disposed along an upper portion of said upstanding portion.

12. A bulkhead as claimed in claim 11 wherein said locking channel is defined along a longitudinal dimension of said bulkhead.

13. A bulkhead as claimed in claim 11 wherein said locking channel is configured to permit forcible, repeatable engagement and disengagement of a locking projection with said locking channel.

14. A bulkhead as claimed in claim 11 wherein said locking channel defines a restricted locking channel opening.

15. A bulkhead comprising a base clip, a base portion, and an upstanding portion wherein:

said base portion and said upstanding portion define at least a portion of a monolithic structure of said bulkhead;

said base clip is not part of said monolithic structure defined by said base portion and said upstanding portion;

said upstanding portion comprises a pair of upstanding walls;

said pair of upstanding walls comprise respective exterior and interior faces;

said pair of upstanding walls are spaced from each other;

said bulkhead comprises at least one chamfered portion extending outwardly from a position substantially co-planar with one of said pair of upstanding walls;

said bulkhead comprises at least one cross-sectional support member extending from an interior face of one of said pair of upstanding walls to an inferior face of the other said pair of upstanding walls; and said bulkhead further comprises a brace portion configured to oppose a cross-longitudinal panel forming pressure applied to said upstanding portion.

16. A bulkhead as claimed in claim 15 wherein said monolithic structure further comprises said brace portion.

17. A panel-forming system comprising a plurality of bulkheads and a panel forming slab wherein:

at least one of said bulkheads comprises a base portion and an upstanding portion;

said base portion and said upstanding portion define at least a portion of a monolithic structure of said bulkhead;

said base portion is configured for securement to said panel forming slab;

said upstanding portion comprises a pair of upstanding walls defining a height dimension of said upstanding portion;

said pair of upstanding walls comprise respective exterior and interior faces;

said pair of upstanding walls are spaced from each other to define a width dimension of said upstanding portion;

said bulkhead comprises a plurality of cross-sectional support members extending from an interior face of one of said pair of upstanding walls to an interior face of the other of said pair of upstanding walls;

said cross-sectional support members are located at respective points along said height dimension of said upstanding portion so as to provide substantial resistance to reduction of said width dimension under pressure applied to one of said exterior faces of said upstanding walls; and said plurality of bulkheads are arranged on said panel forming slab to define length and width dimensions of a panel-shaped cavity such that panel forming material is entirely confined within said panel-shaped cavity to define a panel having peripheral dimensions matching the dimensions of said panel-shaped cavity.

18. A system as claimed in claim 17 wherein at least one of said cross sectional support members comprises a single linear extension.

19. A system as claimed in claim 17 wherein said cross-sectional support members are spaced along said interior faces of said pair of upstanding walls.

20. A system as claimed in claim 17 wherein respective ones of said cross-sectional support members are positioned near corresponding terminal ends of said pair of upstanding walls.

21. A system as claimed in claim 20 wherein said corresponding terminal ends are displaced from said base portion.

22. A system as claimed in claim 21 wherein an additional cross-sectional support member is positioned near said base portion.

23. A system as claimed in claim 21 wherein said cross-sectional support member displaced from said base portion comprises a locking channel.

24. A system as claimed in claim 21 wherein said locking channel defines a restricted locking channel opening.

25. A system as claimed in claim 17 wherein said base portion comprises said at least one chamfered portion.

26. A system as claimed in claim 25 wherein said base portion comprises a pair of chamfered portions extending outwardly from respective positions substantially co-planar with one of said pair of upstanding walls.

27. A system as claimed in claim 26 wherein said pair of chamfered portions extend from different ones of said pair of upstanding walls.

28. A system as claimed in claim 17 wherein at least one of said bulkheads comprises a synthetic material.

29. A system as claimed in claim 28 wherein said synthetic material comprises an extrudable material.

30. A system as claimed in claim 29 wherein said extrudable material comprises a plastic.

31. A system as claimed in claim 28 wherein at least one of said bulkheads comprises a substantially fully synthetic material.

32. A system as claimed in claim 28 wherein a substantial constituent portion of at least one of said bulkheads is a synthetic material.

33. A system as claimed in claim 17 wherein said base portion and said upstanding portion are fabricated from plastic, metal, fibrous composites, and combinations thereof.

34. A system as claimed in claim 17 wherein at least one of said bulkheads comprises an extruded member.

35. A system as claimed in claim 17 wherein at least one of said bulkheads comprises an extruded plastic member.

36. A panel-forming system comprising a plurality of bulkheads and a panel forming slab wherein:

at least one of said bulkheads comprises a base portion and an upstanding portion;

said base portion and said upstanding portion define at least a portion of a monolithic structure of said bulkhead;

said base portion is configured for securement to said panel forming slab;

said upstanding portion comprises a pair of upstanding walls defining a height dimension of said upstanding portion;

said pair of upstanding walls comprise respective exterior and interior faces;

said pair of upstanding walls are spaced from each other to define a width dimension of said upstanding portion;

said bulkhead comprises at least one cross-sectional support member extending from an interior face of one of said pair of upstanding walls to an interior face of the other of said pair of upstanding walls;

said cross-sectional support member is located at a point along said height dimension of said upstanding portion so as to provide substantial resistance to reduction of said width dimension under pressure applied to one of said exterior faces of said upstanding walls;

said cross sectional support member comprises a single linear extension;

said single linear extension is substantially perpendicular to said pair of upstanding walls; and said plurality of bulkheads are arranged on said panel forming slab to define length and width dimensions of a panel-shaped cavity such that panel forming material is entirely confined within said panel-shaped cavity to define a panel having peripheral dimensions matching the dimensions of said panel-shaped cavity.

* * * * *